US007025540B2

(12) United States Patent
MacDonald et al.

(10) Patent No.: US 7,025,540 B2
(45) Date of Patent: Apr. 11, 2006

(54) SHEET PILE

(75) Inventors: Christopher Gerard MacDonald, Ramco (AU); Garry Robert Von Bertouch, Berri (AU)

(73) Assignee: Vonmac PTY LTD, Tranmere (AU)

( * ) Notice: Subject to any disclaimer, the term of this patent is extended or adjusted under 35 U.S.C. 154(b) by 0 days.

(21) Appl. No.: 10/503,373

(22) PCT Filed: Feb. 3, 2003

(86) PCT No.: PCT/AU03/00106

§ 371 (c)(1),
(2), (4) Date: Mar. 23, 2005

(87) PCT Pub. No.: WO03/064773

PCT Pub. Date: Aug. 7, 2003

(65) Prior Publication Data

US 2005/0226690 A1 Oct. 13, 2005

(30) Foreign Application Priority Data

Feb. 1, 2002 (AU) ..... 1472/02

(51) Int. Cl.
*E02D 5/02* (2006.01)

(52) U.S. Cl. ..... 405/281; 405/274; 405/280

(58) Field of Classification Search ..... 405/274, 405/275, 276, 277, 278, 279, 280, 281, 284, 405/285, 272

See application file for complete search history.

(56) References Cited

U.S. PATENT DOCUMENTS

| | | | | |
|---|---|---|---|---|
| 1,178,521 | A * | 4/1916 | Keelyn | 405/275 |
| 4,448,571 | A * | 5/1984 | Eckels | 405/284 |
| 4,632,602 | A * | 12/1986 | Hovnanian | 405/129.8 |
| 5,360,293 | A * | 11/1994 | Breaux et al. | 405/274 |
| 6,695,534 | B1 * | 2/2004 | Cain et al. | 405/52 |
| 6,758,634 | B1 * | 7/2004 | Nickelson et al. | 405/276 |

FOREIGN PATENT DOCUMENTS

| | | |
|---|---|---|
| AU | 12294/23 | 5/1924 |
| AU | A 52985/98 | 8/1998 |
| GB | 2 314 575 A | 1/1998 |
| WO | WO 89/07172 A1 | 8/1989 |
| WO | WO 00/47828 A1 | 8/2000 |

OTHER PUBLICATIONS

PCT International Preliminary Examination Report, corresponding to PCT/AU2003/000106, completed May 10, 2004.

PCT Search Report, corresponding to PCT/AU2003/000106, mailed Feb. 20, 2003.

* cited by examiner

*Primary Examiner*—Frederick L. Lagman
(74) *Attorney, Agent, or Firm*—Kilpatrick Stockton LLP

(57) ABSTRACT

An elongated element (1) having a cross-sectional shape permitting the element to be interlocked with adjacent elements, the element having a basic square shape with interlocking members (4,6,8) on at least three sides of the element, wherein the proportions of the element and the interlocking members are such that the elements can be interlocked in side by side and/or overlapping relationship.

8 Claims, 8 Drawing Sheets

SHEET PILE

This invention relates to a sheet pile and sheet piling formed by a plurality of sheet piles.

Sheet piles to form walls, retaining walls, soil and/or water retaining walls, barriers and the like are well known. These have been formed of various materials, including wood and in latter years in large sections by cast steel and in smaller sections by rolled steel.

More recently sheet piles have been made from plastic materials such as an extruded polymeric material and fiberglass. Also it is known to join sheet piles together either by nesting shaped portions together or interlocking so that all sheet piles are locked together. Examples of various forms of pile sheeting are U.S. Pat. Nos. 4,917,543; 5,145,287; 5,066,353; 6,042,306; 6,053,666; 3,688,508; 3,302,412.

However while it is noted various of these have interlocking features, the interlocking is in one or a limited number of directions. Also the sheet piling may require more than one basic shape of sheet pile. Additionally not all have load bearing characteristics.

It is an object of this invention to provide sheet piling to overcome one or more of the deficiencies of prior art sheet piling.

It is a further object to provide sheet piling to interlock in a plurality of directions and manner.

A still further object of the invention to provide extruded sheet piling from plastics material and recycled plastics material.

Thus there is provided according to the invention an elongated element having a cross sectional shape permitting the element to be interlocked with adjacent elements, the element having a basic square shape with interlocking members on at least three sides of the element, wherein the proportions of the element and the interlocking members are such that the elements can be interlocked in side by side and/or overlapping relationship.

Preferably the interlocking members are one on each of three sides of the element, the fourth side being plain.

Preferably one interlocking member on one side is a socket and the each of the other two sides have a spigot.

Preferably each spigot has a head joined by a neck to the element and the socket has a socket recess on each side of the socket whereby adjacent elements are locked by sliding one element longitudinally of the other element with the spigot engaging the socket.

Preferably the width of the spigot head and the distance between the socket recesses is one half the width of the square shape.

Preferably the depth of the socket and the distance of the head of the socket from the square is one quarter of the width of the square shape.

In order to more fully describe the invention reference will now be made to the accompanying drawings in which:

FIG. 2(*a*) shows various orientations of the sheet pile,

Figure 1:
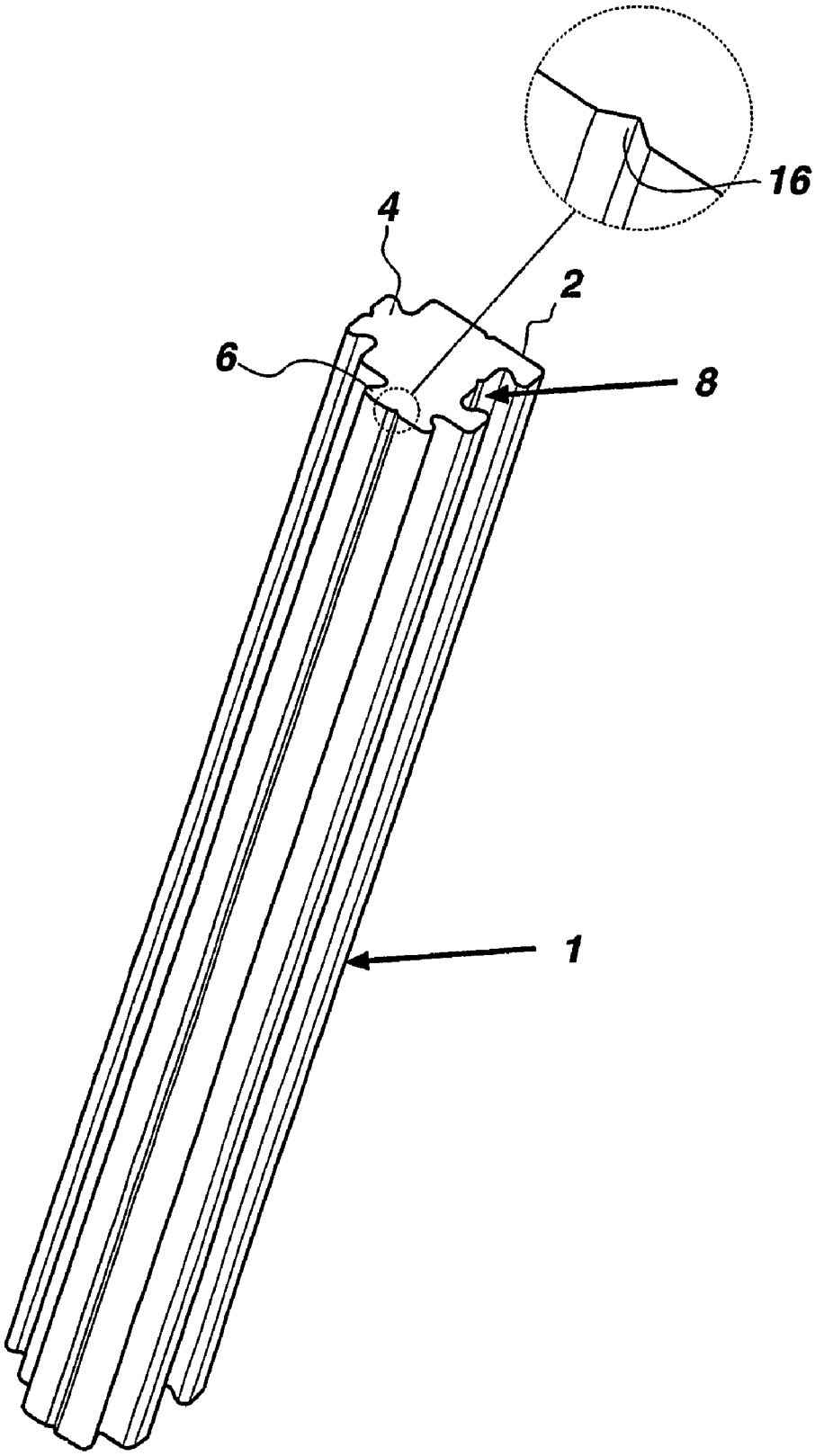
FIG. 1 is a perspective view of a sheet pile according to the invention.
Figure 2:
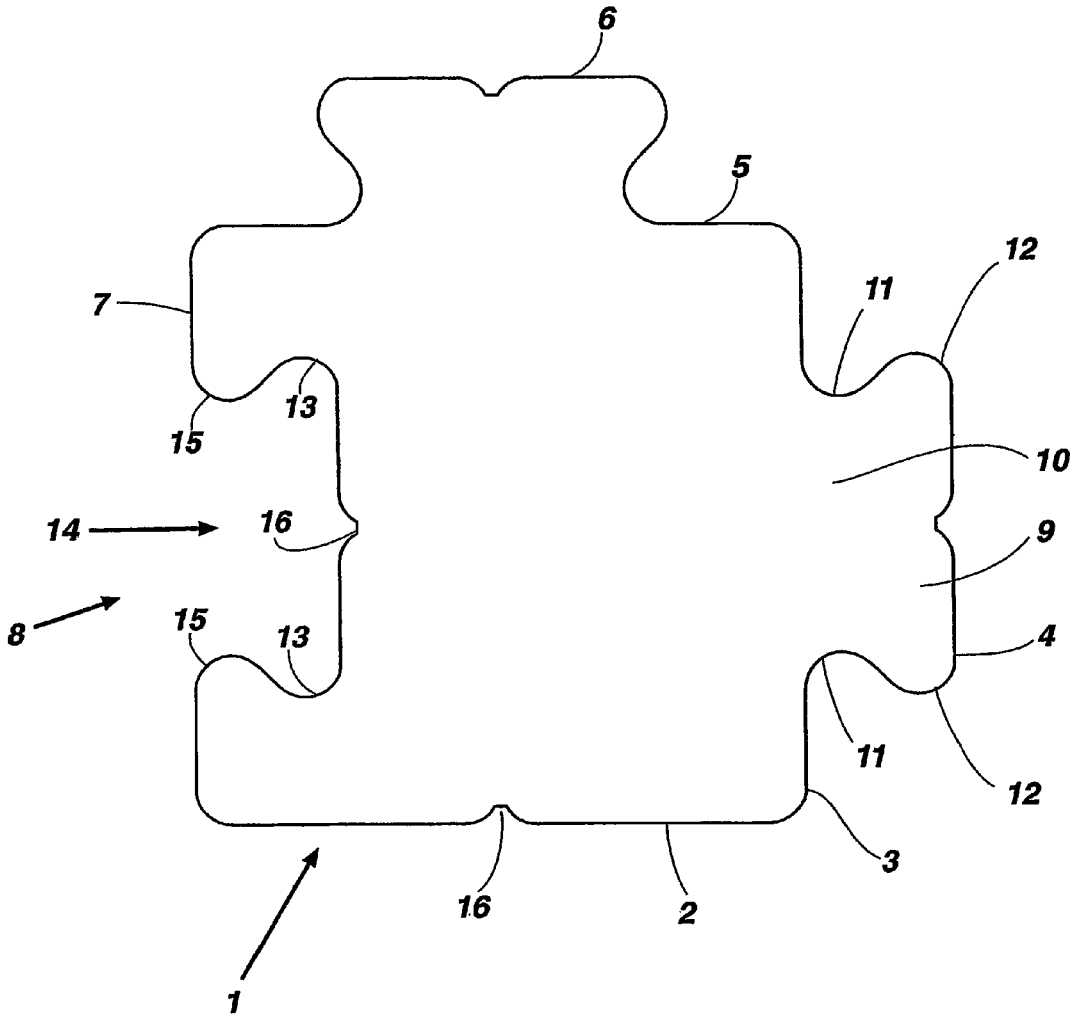
FIG. 2 is an end view of the sheet pile of FIG. 1.
Figure 2A:
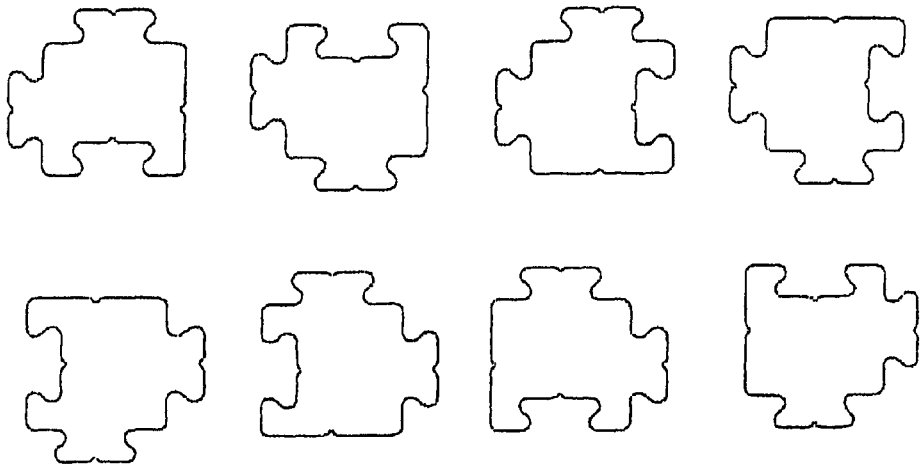

The sheet pile is of indefinite length and in cross section has a basic square body 1 with one flat side 2. The adjacent side 3 has a spigot 4 and the side 5 opposite to side 2 also has a spigot 6 identical to spigot 4. The remaining side of the pile 7 adjacent side 2 has formed therein a socket 8 complimentary in shape to the profile of the spigots 4 and 6.

The spigot 4 has a head 9 joined to the body 1 by a neck 10 by smooth curves 11 and 12. The socket 8 has a shape to compliment the shape of the spigot, the socket having side recesses 13 to compliment the surfaces 12 of the head 9 of the spigot, the opening 14 to the socket having curved surfaces 15 and 13 to match the surfaces 11 and 12 of the spigot.

Thus in effect the spigot and socket form a rounded dovetail joint.

The proportions of the various portions of the sheet pile are such that the sheet piles can be assembled in various combinations.

The sheet piles are extruded and as shown in 2(*a*) there are 8 possible variations for using the sheet piles by inverting the sheet pile.

Figure 8:
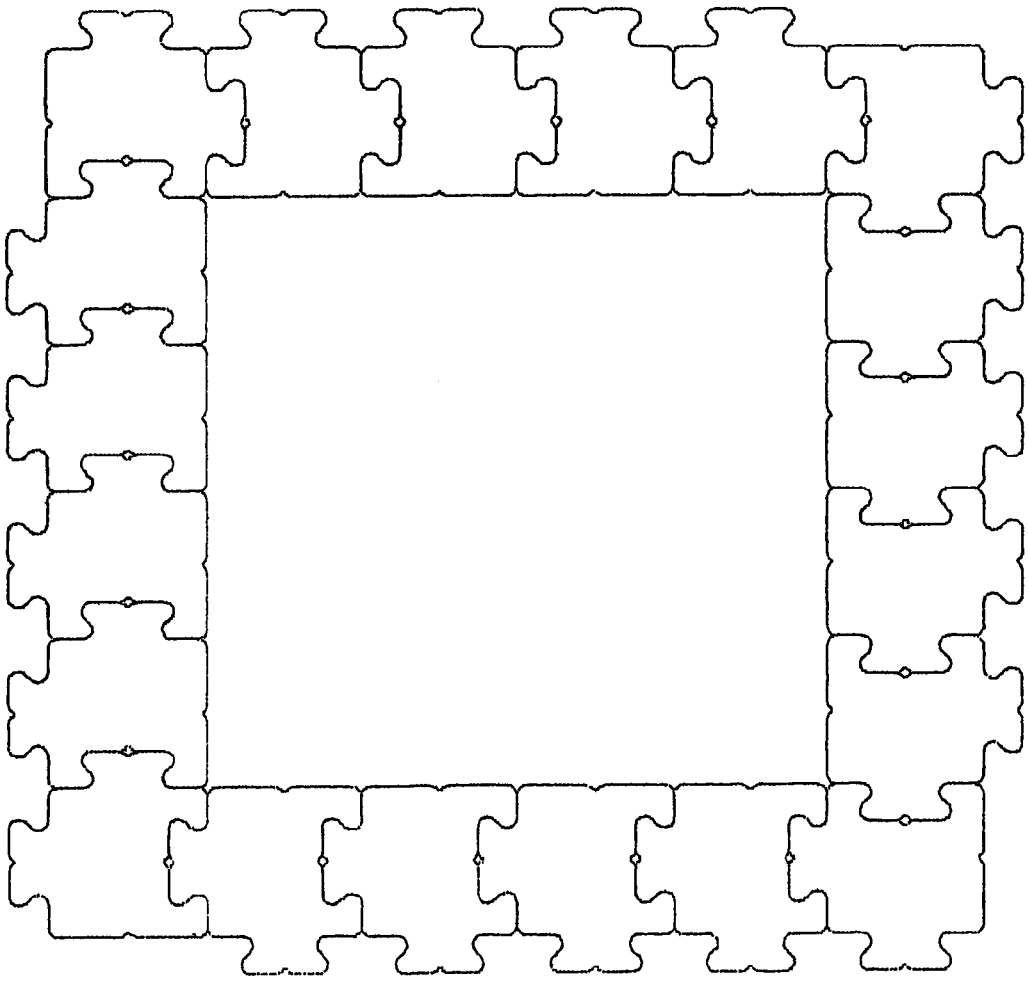

Thus the sheet piles can be locked together by sliding one sheet pile down along the adjacent sheet pile. The simplest assembly can be by joining the spigot into the socket as in FIG. 8, being either in a straight line or to form the arrangement as shown in FIG. 8.

This arrangement is one arrangement of the sheet piles forming a virtually smooth wall which in many installations is very desirable or sometimes essential.

Thus each individual sheet pile has the flat side and by the provision of a spigot on the two of the other sides and a socket on the remaining side various combinations of arrangements can be made. The proportions of the spigot, the neck of the spigot and the corresponding opening of the socket are such that the portions of the sides of the body from the corners to the neck and the opening to the socket are such that the sheet piles can be arranged in overlapping arrangements.

Figure 3:
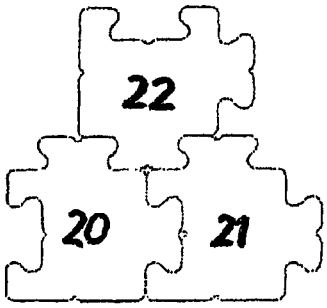
FIGS. 3 to 10 illustrate various combinations of the sheet pile.

In FIG. 3 sheet piles 20 and 21 are locked by the spigot of 20 engaging in the socket of 21. Sheet pile 22 is attached to bridge sheet piles 20 and 21 by its spigot engaging the resulting socket formed between the side spigots of sheet piles 20 and 21.

Figure 4:
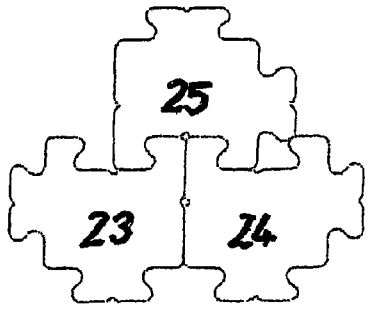

FIG. 4 shows a further arrangement with sheet piles 23 and 24 arranged with the flat sides abutting. Sheet pile 25 locks 23 and 24 together by it's socket passing over the adjacent side portions thus forming a spigot from sheet piles 23 and 24. The side portions of the sockets are so dimensioned and proportioned that placed as shown form a spigot.

Thus it can be seen that the distance between the opening to the recess and the respective adjacent corner of the flat side thus forming socket side portions, is such that when two such side portions of a first and second adjacent sheet pile abut along their flat sides each other these two socket side portions form a spigot to be inserted into a socket of a further sheet pile thus locking the first and second sheet piles together.

Similarly when a third and fourth sheet piles are interengaged with their flat sides aligned by the spigot of the third sheet pile engaging the socket of the fourth sheet pile, a resulting socket is formed between the spigots of the third and fourth sheet piles on the opposite side to the plain faces. A further sheet pile can be attached by its spigot into this so formed resulting socket.

The relationship and proportions of the dimensions of the basic square shape and the dimensions and shape of the spigots and recesses are such that the portions of the sides of the square between the recess opening and the neck of the spigot is such that each of these portions form one half of either a spigot or recess.

Figure 5:
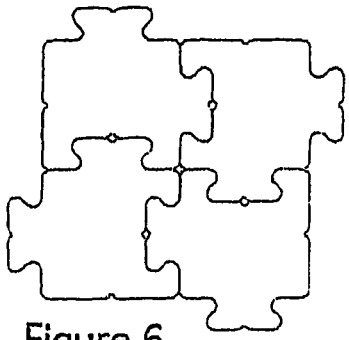
Figure 6:
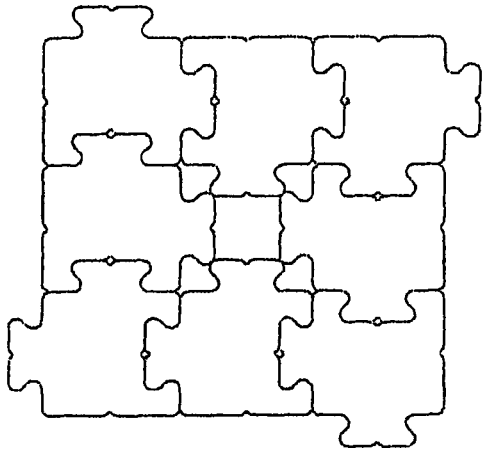
Figure 7:
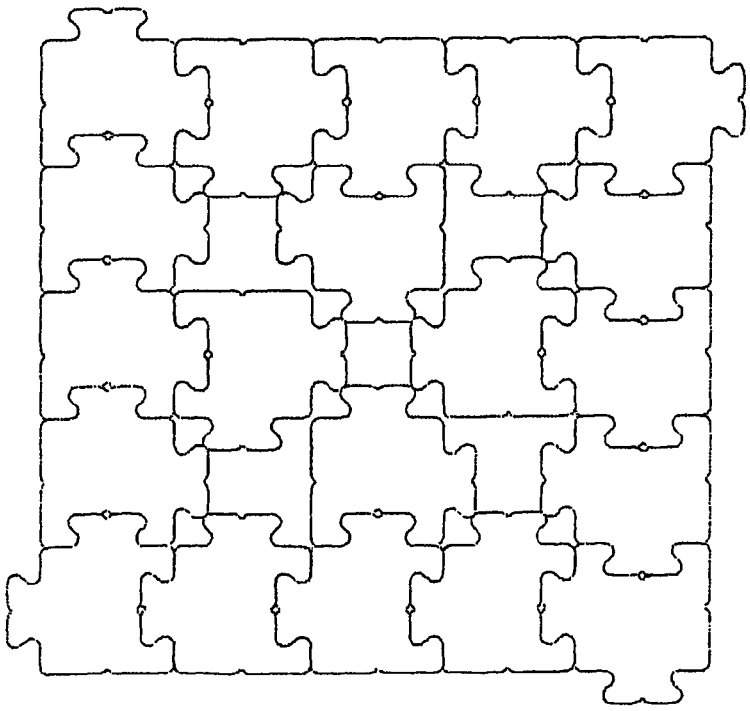
Figure 9:
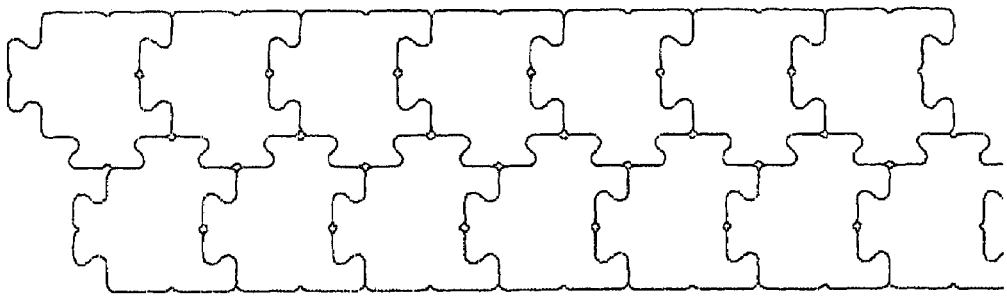
Figure 10:
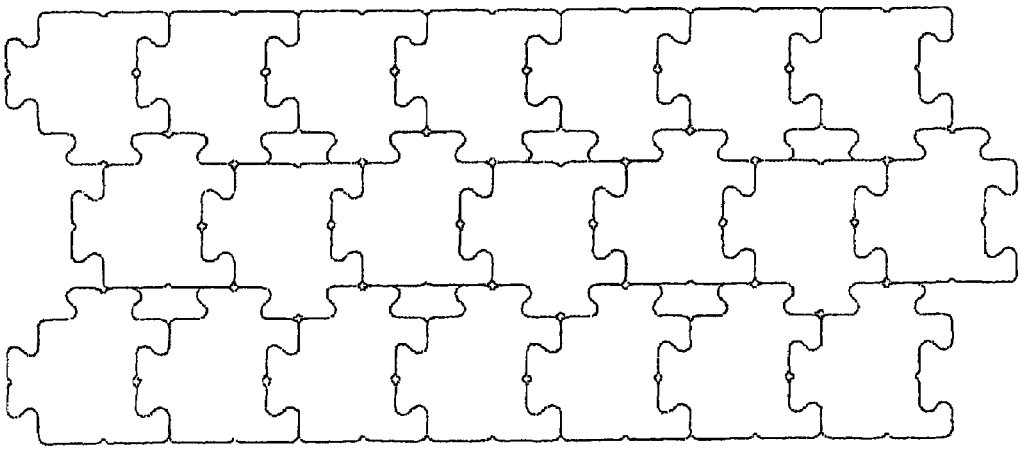

As shown in FIGS. 5, 6 and 7 the sheet piles can be arranged to form a block in situations where substantial strength is required. FIG. 8 shows an arrangement of sheet piles to enclose an area. Also the sheet piles as shown in FIGS. 9 and 10 can be arranged to provide a wall of thickness greater than a single row of sheet piles. It is noted the plain face and each of the spigots and sockets have a small recess or the like 16 such when assembled the recesses or cavities are aligned so that a small hole or bore extends the length of the sheet piling. A solid wall or structure can be produced by injecting a suitable solvent into the hole or bore. A sheet pile can be driven from either end to facilitate the interlocking variations to form a wall, block or chamber.

Figure 11:
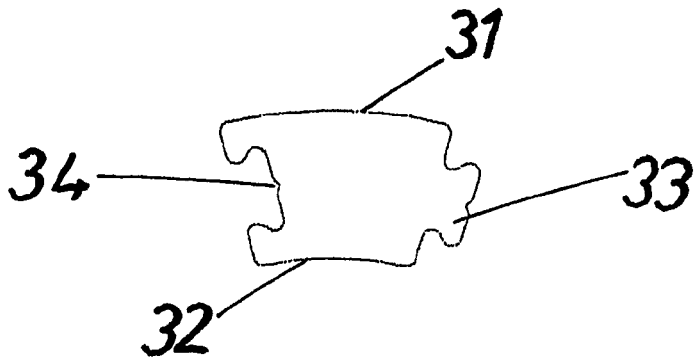
FIGS. 11 to 13 show the application of the invention to a curved sheet pile.
Figure 12:
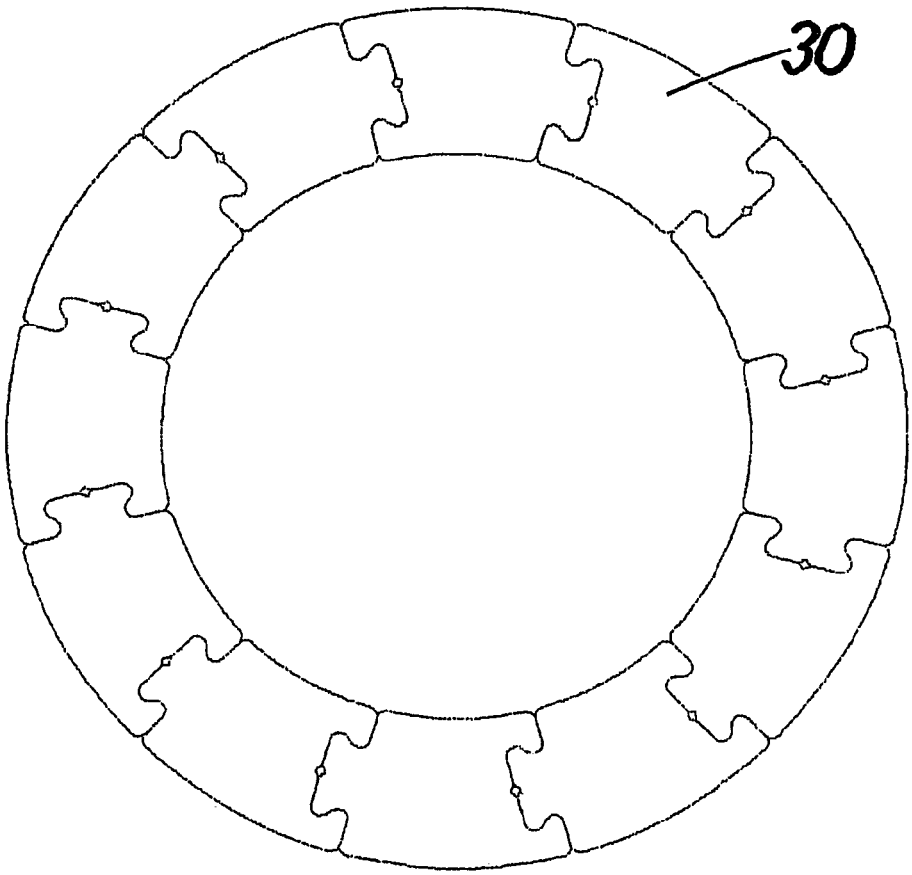
Figure 13:
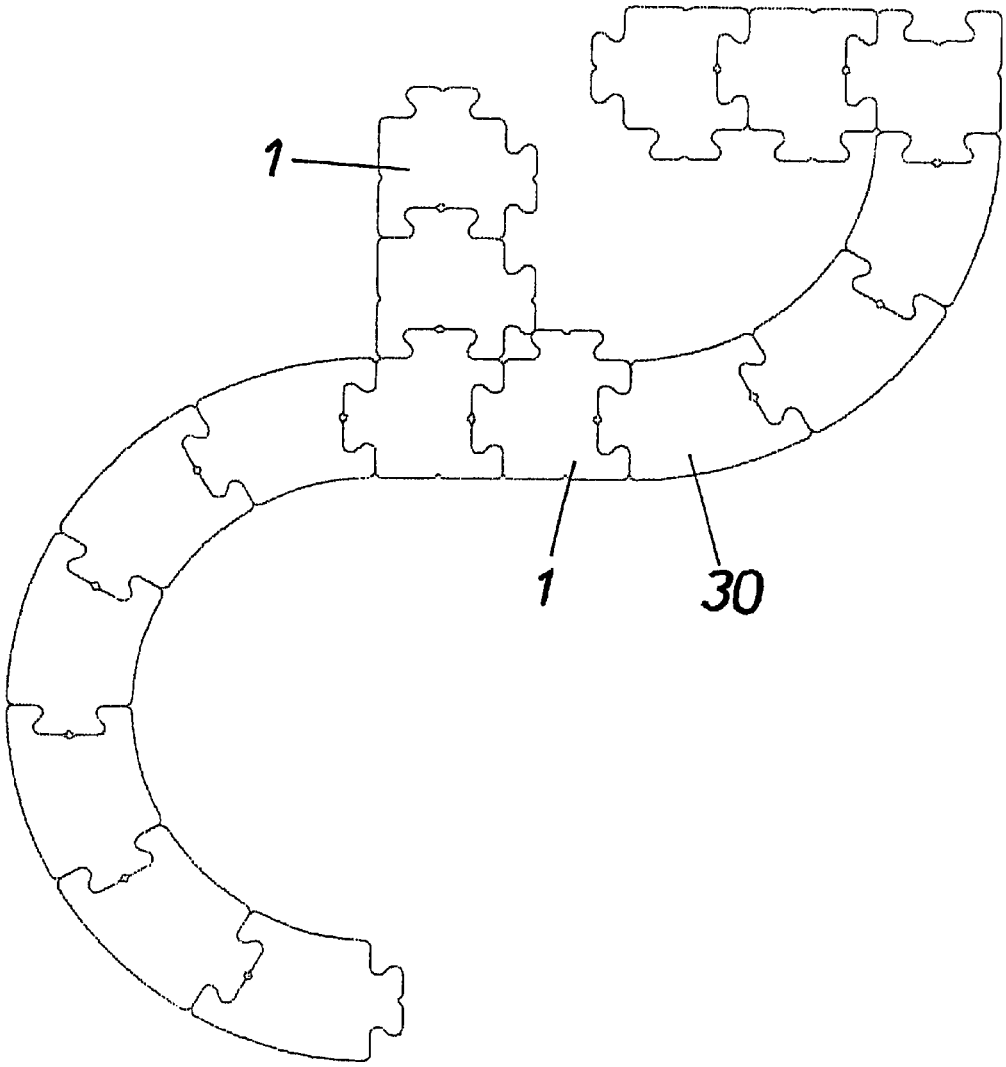

FIGS. 11 to 13 show the adaptation of the invention to a curved sheet pile 30 having a pair of curved sides 31 and opposite side 32. The remaining sides are provided with a spigot 33 and a socket 34. The ends of the sheet pile having the spigot and socket are each of the same dimensions respectively as the sides of the sheet pile 1 and the respective spigots and sockets. This then enables the curved sheet piles to be arranged as for example in FIGS. 12 and 13 and to be attached to and joined to the sheet piles having the configuration of FIG. 1.

Thus it can be seen the sheet piles of the present invention have great versatility in being arranged in a large number of arrangements to provide greater strength where required. The sheet piles maybe formed from any suitable material, and for example may be extruded from plastics material, preferably recycled plastic waste, however the material may be selected from polymer, reinforced polymer, fiberglass, epoxy resins, cement, wood and combinations thereof. In addition the sheet piles may be of hollow section plastics material formed by extrusion, or formed from metal either by extrusion or from rolled steel. Depending on the proposed use, the metal sheet piles may require surface coating to protect the surface of the metal. Also if desired the sheet pile can be reinforced.

The invention also provides a sheet piling or wall that is simple, economical to produce corrosion free, reusable, interlocks in more than one direction can form a wall of various thicknesses, is water tight, and provision is made in the design to inject a solvent so that the wall becomes a solid.

Although one form of the invention has been described in some detail the invention is not to be limited thereto but can include variations and modifications falling within the spirit and scope of the invention.

The invention claimed is:

1. An elongated sheet pile element having on a first pair of opposing faces a spigot and a socket adapted to accept the spigot of a further element, and on a further pair of opposing faces a spigot and a substantially flat face, whereby the distance of a first portion of the element between the spigot and the adjacent corner of the element being such that when two elements are positioned adjacent each other, the first two portions form a socket adapted to accept the spigot of a further element, and the distance of a second portion of the element between the socket and its adjacent edge is such that when the two elements are positioned abutting each other two second portions form a spigot adapted to be inserted into the socket of a further element.

2. The elongated element as defined in claim 1, wherein each spigot has a head joined by a neck to the element in the form of a rounded dovetail, and the socket has a recess on each side of the socket that is adapted to receive the rounded dovetail of a further element, whereby adjacent elements are locked by sliding one element longitudinally of the other element with the spigot engaging the socket.

3. The elongated element as defined in claim 2, where in the portions of the element extending from the recess to the edge of the element are such that when two elements are positioned with their respective flat sides abutting the two said portions form a spigot whereby a further element can engage its socket over the formed spigot to lock the elements together in overlapping relationship.

4. The elongated element as defined in claim 2, wherein the portions of the element extending from the spigot to the edge of the element are such that when two elements are positioned with their flat sides aligned the two said portions form a socket whereby a further element can engage its spigot in the so formed socket to lock the elements together in overlapping relationship.

5. The elongated element as defined in claim 1, wherein the element is hollow.

6. The elongated element as defined in claim 1, wherein the element is formed by extruding a plastic material or recycled plastic material.

7. The elongated element as defined in claim 1, wherein the element is constructed from a plastic material, cement, wood, metal or combinations thereof and whether reinforced or not.

8. The elongated element as defined in claim 1, wherein longitudinal recesses or grooves are provided such that when assembled with a further element, a longitudinal hole or canal is formed into which a sealing compound or solvent can be placed.

* * * * *